United States Patent [19]

Van Auken

[11] 4,023,799

[45] May 17, 1977

[54] GAME RACKET

[75] Inventor: Richard L. Van Auken, Somerville, N.J.

[73] Assignee: Exxon Research & Engineering Co., Linden, N.J.

[22] Filed: Jan. 24, 1974

[21] Appl. No.: 436,142

[52] U.S. Cl. ..... 273/73 F; 273/73 C; 273/73 G; 273/DIG. 7; 273/DIG. 23

[51] Int. Cl.[2] ..... A63B 49/10

[58] Field of Search ..... 273/67 R, 73 R, 73 C, 273/73 F, 73 G, 80 R, 80 B, DIG. 7, DIG. 23; 280/11.13 L

[56] References Cited

UNITED STATES PATENTS

| | | | |
|---|---|---|---|
| 1,898,485 | 2/1933 | Hall | 273/73 G |
| 2,099,735 | 11/1937 | Hall | 273/73 G |
| 2,414,125 | 1/1947 | Rheinfrank | 273/73 F UX |
| 2,428,325 | 9/1947 | Collins | 273/73 F UX |
| 2,742,931 | 4/1956 | De Ganahl | 273/DIG. 7 |
| 2,878,020 | 3/1959 | Robinson | 273/73 F |
| 3,483,055 | 12/1969 | Eshbaugh | 273/73 F X |
| 3,640,533 | 2/1972 | Davis | 273/73 K X |
| 3,690,658 | 9/1972 | Howe | 273/73 F X |
| 3,691,000 | 9/1972 | Kalnin | 273/73 F X |
| 3,740,301 | 6/1973 | Manning et al. | 273/73 F UX |
| 3,755,037 | 8/1973 | Erwin et al. | 273/73 F X |
| 3,787,051 | 1/1974 | Johns | 273/73 F |
| 3,889,951 | 6/1975 | Schaefer et al. | 273/73 F |
| 3,902,732 | 9/1975 | Fosha et al. | 273/73 F X |

FOREIGN PATENTS OR APPLICATIONS

| | | | |
|---|---|---|---|
| 103,895 | 5/1938 | Australia | 273/73 F |
| 21,151 | 1/1935 | Australia | 273/73 F |
| 2,033,630 | 11/1970 | France | 273/73 F |
| 347,317 | 4/1931 | United Kingdom | 273/73 G |
| 858,169 | 1/1961 | United Kingdom | 273/73 G |

*Primary Examiner*—Richard J. Apley
*Attorney, Agent, or Firm*—Joseph J. Dvorak

[57] ABSTRACT

A game racket is provided that has high bending and torsional stiffness. The racket has a central core and a fiber reinforced plastic skin on the core. The fiber reinforced plastic skin is generally disposed on the faces of the core parallel to the striking plane and covering at least the head portion and the throat sections of the racket. The fibers are continuous and layered. The fiber in the throat section is crossplied at alternating angles as measured from the longitudinal axis of the racket frame. The fibers on the surface of the head portion are aligned with the general contour of the head portion.

12 Claims, 6 Drawing Figures

GAME RACKET

BACKGROUND OF THE INVENTION

The present invention relates to game rackets used in playing tennis, badminton, squash and the like. More particularly, the present invention relates to a novel frame for such rackets and a method of fabricating the frame.

It is well known that the playing characteristics of a game racket such as a tennis racket, are effected by a number of factors, including the design and the material from which the frame of the racket is constructed. For example, a tennis racket which is constructed with a wooden frame has good torsional stiffness characteristics enabling the player to maintain touch control during strong play, especially when the ball is hit off-center. On the other hand, metal rackets generally have better bending stiffness characteristics than wood rackets, thereby enabling the player to hit the ball with a considerable degree of power and often without feeling the vibrational stresses. Thus, in the past, the choice of a racket having a metal frame required the player to sacrifice the torsional characteristics of wood rackets while the choice of a racket having a wood frame meant the loss of the better bending characteristics of the metal rackets.

BRIEF SUMMARY OF THE INVENTION

The present invention comprehends an improved game playing racket which combines the best properties of wood and metal rackets and offers tailorability for maximum performance. Briefly, the racket of the present invention has a central core having a handle portion and a head portion defining a striking plane. The junction of the head portion and the handle portion defines a throat section of the frame. At least the head portion and the throat section have fiber reinforced plastic skin thereon. The fiber reinforced plastic skin serves as the racket faces, i.e., the reinforced plastic skin is on the opposing surfaces of the core parallel to the striking plane of the frame. The fibers in the reinforcing plastic skins are continuous fibers. The orientation of the fibers in the area of the throat section of the frame is at an angle ranging generally between ±45° to about ±25° and preferably ±30° as measured from the longitudinal axis of the frame. Superior bending stiffness is afforded with the optional addition of fibers oriented at 0° with respect to the longitudinal axis of the frame without loss of torsional stiffness. In the head portion of the racket, however, the continuous fibers are arranged so as to be substantially parallel to the contour of the head portion. For example, if the head portion is elliptically shaped then the fibers will be oriented in an elliptical pattern. In the case of a circular head portion, the fibers would be arranged in substantially a circular pattern.

The fiber reinforced plastic can be formed from any number of fiber reinforced plastic resins commercially available; however, it is preferred that the fiber reinforced plastic resin be selected from graphite fiber, glass fiber, organic or inorganic fiber, reinforced thermoplastic resins or modified thermoset resins and mixed glass fiber, graphite fiber, organic or inorganic fiber, reinforced thermoplastic resins or modified thermoset resins.

Similarly, a number of materials may be used as the core for the racket frame, such as plastic composites, low density cellular plastic materials, wood and the like. In the preferred embodiment of the present invention the core of the racket is a wood laminate.

These and other embodiments of the invention will become apparent from the following detailed description especially when read in connection with the accompanying drawings.

DETAILED DESCRIPTION OF THE PREFERRED EMBODIMENTS

In the exemplary embodiment of the invention shown in FIGS. 1 to 6 of the drawings, a game racket 11 includes a frame having a head portion 12 defining a striking plane 14 transversed by strings 15 defining a striking surface designated generally as 16. The frame of racket 11 includes a handle portion designated generally as 17.

Figure 1:
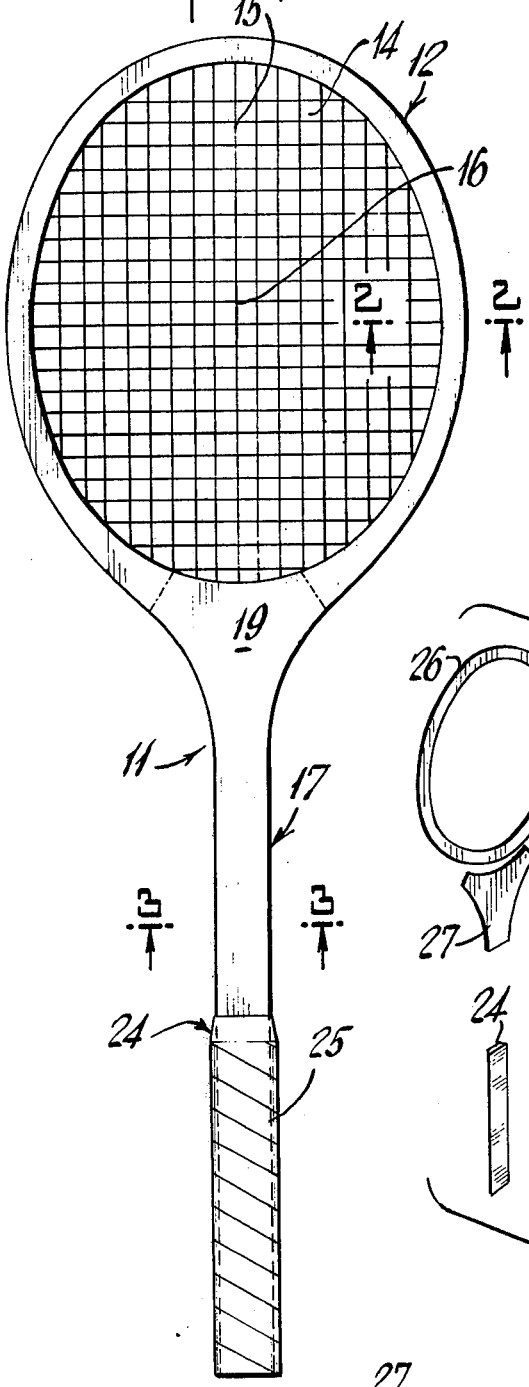
FIG. 1 is a front elevation of a game playing racket according to one embodiment of the present invention.
Figure 5:
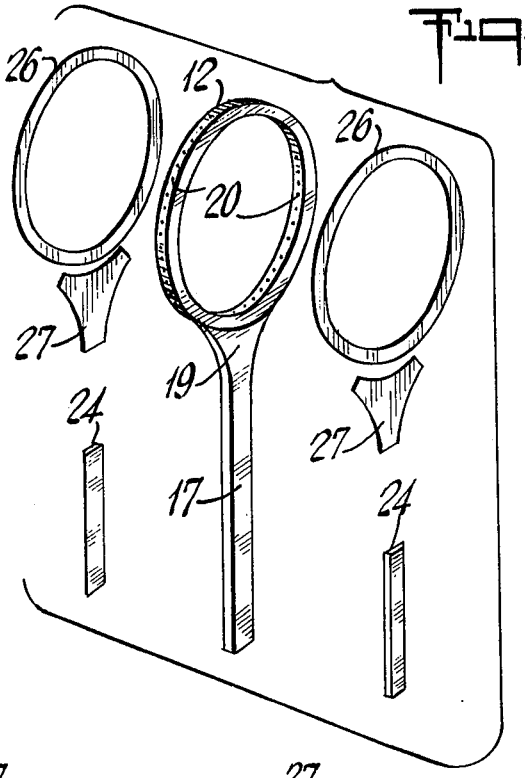
FIG. 5 is an isometric view of a racket frame according to this invention also shown partially in perspective.
Figure 4:
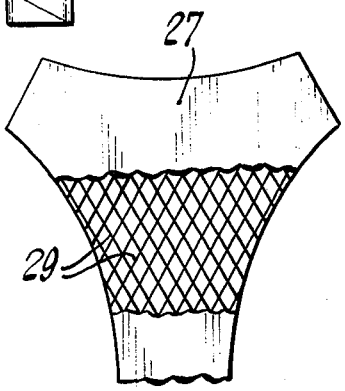
FIG. 4 is a plan view of fiber reinforced skin for the throat section of the racket partially cut away showing the fiber orientation in the throat skin.
Figure 6:
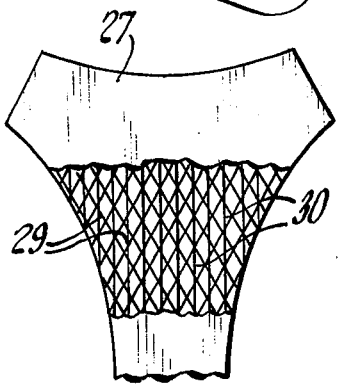
FIG. 6 is a plan view of fiber reinforced skin for the throat section of the racket of this invention, shown partially cut away to illustrate an alternate fiber orientation in the throat skin.

The handle portion 17 and the head portion 12 of the frame of racket 11 are integral with each other and define at their point of juncture an area generally known as the racket throat and designated in FIGS. 1 and 5 as 19.

The head portion 12 of racket 11 has a plurality of apertures 20 for accommodating the stringing of both horizontal and vertical strings therethrough. Other suitable means, of course, can be provided in head portion 12 for stringing racket 11.

Around the handle portion 17 of racket 11 is provided a conventional grip 25 which is made from any suitable material such as plastic or leather. Grip 25 is mounted on handle portions 17 by any conventional technique.

As can be seen from FIGS. 1 and 5 the handle pallets 24 are provided to enlarge the area of handle portion 17 thereby providing for a more comfortable grip.

Turning now to FIG. 5, the basic elements of racket 11 are seen as a central core having a head portion 12 and a handle portion 17 integral with the head portion and defining at the juncture between the head portion and the handle portion a throat section 19. The racket frame also has a fiber reinforced plastic skin on the head portion which head skin is substantially identical in contour to the continuously oval head portion. In FIG. 5, the head reinforcing skin portion is shown as reference numeral 26. As can be seen, the head skin 26 is applied to the opposing faces of the core and parallel to the striking plane. The throat reinforcing skin 27 is applied to the opposing faces of throat section 19 of the racket frame.

In addition to the foregoing basic elements of the racket frame in FIG. 5, handle pallets 24 are shown.

Generally, the core of the racket frame 11 should be constructed of quality materials exhibiting the necessary strength and toughness to withstand extreme play. For example, if a wood core is used, it should be of good quality ash and hickory laminated without voids or discontinuities. Optionally, other core materials may be used, such as plastic composites and cellular plastic materials that have relatively low densities yet sufficient strength. In the preferred embodiment of the instant invention, the core material is a wood laminal 18, the individual laminal of which can be seen in FIGS. 2 and 3.

The materials useful for the skin of the racket include graphite fiber reinforced thermoplastic resins and mixed glass fiber and graphite fiber reinforced thermoplastic resins. The particularly preferred thermoplastic resin is nylon; however, other thermoplastics such as polypropylene, acrylic acid modified polypropylene, polycarbonates, polyesters, polyacetals and polysulfones and the like may be employed. The preferred fiber reinforcement employed in the resins of the instant invention is continuous graphite fiber.

Generally, the skin will contain 30 to 65% of fiber by volume; however, the precise range of fiber loading will vary depending upon the fibers and resin employed, the thickness of the skin and the core chosen for the frame. Suffice it to say that generally the fiber loading will be in the range of about 30 to 65%; however, the preferred range of fiber loading is from about 50 to 55% by volume of graphite in nylon resin.

The skin, both in the throat and head portions of the racket, generally are in the range of about 20 to about 60 mils in thickness; although it is particularly preferred to use a skin ranging generally from about 35 to 40 mils in thickness.

Figure 2:
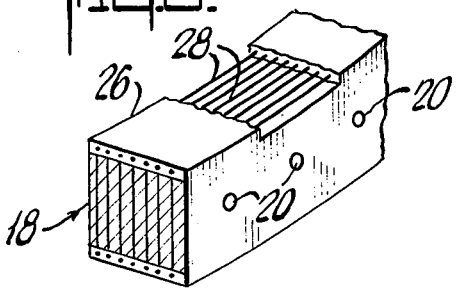
FIG. 2 is a fragmentary cross sectional perspective view of the frame of FIG. 1 taken along line 2—2.
Figure 3:
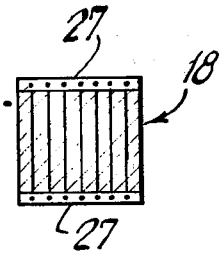
FIG. 3 is a transverse section taken substantially along line 3—3 of FIG. 1.

In order to get the requisite durability and playing characteristics for the game racket, the orientation of the continuous fibers in the plastic matrix is extremely important. As can be seen in FIG. 2, continuous fiber reinforcement 28 is arranged in a circumferential pattern. In other words, the orientation of the fibers in the skin of the head portion follows the same contour of the head portion of the racket. This substantially oval or circular arrangement of the fibers in the head portion of the skin imparts circumferential stiffness to the frame allowing more effective use of the strings during impact, and adds significantly to the playability of the total hitting area as well as its strength.

On the other hand, the fibers for the throat skin 27 are oriented at an angle of from about ±45° to about ±25° and preferably ±30° as measured from the longitudinal axis of the racket. This orientation can be seen clearly in FIG. 4. It has been found that this orientation of the fibers in the throat section is necessary to adequately upgrade and control the torsional characteristic of the racket. Optionally, a portion of the fibers in the throat skin 27 may be placed at a 0° orientation as measured from the longitudinal axis of the frame to control the bending characteristics of the racket. Thus, in FIG. 6 reinforcing fibers 29 having a ±30° orientation are shown as well as fibers 30 having a 0° orientation. The amount of fibers having a 0° orientation in the throat skin generally will not exceed 50% of the total fibers in the throat skin and preferably will range from 0 to about 30% of the total fibers in the throat skin.

The head skin sections 26 can be formed by any number of techniques well known in the art. For example, commercially available graphite fiber which is pre-impregnated with a resin may be wound on a mandrel that has a shape substantially identical to the shape of the head portion of the racket frame. Winding can be continued until the thickness of resin and fiber are built up on the mandrel to an amount equal to the width of the head portion of the racket. The wound fiber resin material is then set and the mandrel removed to provide head skins 26.

The throat skins 27 are readily prepared by stamping head skins from thin sheet material containing the fibers with the desired orientation. These techniques are well known in the art.

Prior to bonding the head skins and throat skins to the core of the racket, the faying surfaces of the skins are pretreated so as to improve the bonding of the skins to the core. Generally, the pretreatment consists of roughing the faying surfaces. For example, the faying surfaces are sandblasted; however, other techniques such as sandpapering or otherwise roughing the surface sufficiently may be employed.

After pretreating the faying surfaces of the plastic skins, the skins are bonded to the core of the racket. For bonding the skins, generally an elastomer modified thermoset adhesive is employed such as an acrylic thermoset resin having a high elongation and peel strength. After applying the adhesive and the skin, the bonding is achieved at temperatures ranging from about ambient up to about 120° C. and at pressure of from about atmospheric to pressures ranging up to about 3 atmospheres. Most generally, it is sufficient to bond at ambient temperature and at one atmosphere of pressure.

Since the throat skin 27 will overlap the head skin 26 in the immediate vicinity of the juncture of the throat and head portion of the racket frame it is especially preferred that the head portion of the core be slightly undercut. Indeed, the depth of the undercut is preferably equal to the thickness of head skin 26.

In any event, head skin 26 is applied to the core as stated above and then throat skin 27 is applied with adhesive in the manner set forth above. This overlap of throat and head skin contributes to the exceptional durability as well as playing characteristics of the racket in that it provides for a relatively smooth transition in the load bearing fiber thereby eliminating sharp breaks in load bearing members which gives rise to weak junctures.

Illustrative of the procedure outlined above several rackets were fabricated by adhesively bonding fiber reinforced skins onto a wood core in the manner outlined above. The skins were made from commercially available graphite fibers preimpregnated with nylon resins and sold. The racket cores were wood and the adhesive for bonding the skins to the core was an elastomer modified thermoset epoxy adhesive sold under the tradename FM-123 by American Cyanamid Company, New Jersey.

The physical properties of the racket frames made according to this invention are compared with commercially available racket frames in Table 1 below.

The bending stiffness was determined by a cantilever beam test used by racket manufacturers. In this test the handle portion of the racket frame is clamped, 20 lbs. of weight is applied 15 inches from the clamp and deflection at the tip of the head portion 20 inches from the clamp is measured.

The torsional stiffness was measured by applying the torque of 45 inch pounds, 9.5 inches from the clamped handle portion. The twist in the plane normal to the longitudinal axis of the handle was then measured 5 inches from the clamp.

Table 1

| Racket Type | Weight in Grams | Bending Stiffness - Max. Defl. In. | Torsional Stiffness - Max. Defl. In. |
|---|---|---|---|
| This invention | 375 | .500 | .075 |
| Typical All Wood | 375 | .575 | .120 |
| Typical All Steel | 375 | .550 | .160 |
| Composite/Aluminum | 375 | .850 | .102 |

As can be seen from the foregoing data the composite racket of the instant invention has exceptional torsional characteristics.

Additionally, the racket of the instant invention is shown to have exceedingly exceptional durability. The durability is established by stringing a racket made according to this invention at 55 lbs. tension and placing it in a machine for repetitively hitting a tennis ball at programmed speeds. For example, the racket makes 10,000 strokes at 45 miles/hour, 10,000 strokes at 50 miles/hour, and 10,000 strokes at 55 miles/hour. At the end of the test regimen the racket was carefully checked for any indications of flaws and even under these severe test conditions the racket of this invention is shown to have excellent durability as compared with commercial rackets. Enhanced durability apparently is the result of lower bending and torsion deflections imparted by the stiffness and load carrying properties of the graphite.

More importantly, however, the rackets of the instant invention were field tested by players and found to possess excellent balance and exceptional playing characteristics. Indeed, the fiber orientation in the throat section combines with the fiber orientation in the head section of the racket providing overall improvement in control and feel of the racket. The players testing the racket generally indicate that its "sweet spot" has been significantly enlarged by virtue of the instant invention.

What is claimed is:

1. A racket comprising: a frame core having a head portion of curvilinear shape defining a striking plane and a handle portion integral therewith, said head portion and handle portion defining a throat section at the junction of the handle and the head portion; a fiber reinforced plastic skin on each of the opposing faces of the head portion of the core parallel to the striking plane, said skin on the head portion of the core having continuous fibers oriented solely in a closed curvilinear pattern following the curvilinear shape of the core in the head portion of the racket whereby circumferential stiffness is imparted to said frame; a fiber reinforced plastic skin on each of the opposing faces of the throat section of the core, said skin on the throat section of the core overlapping the skin on the head portion of the core only at the junction of the handle and the head portion, said skin on the throat section of the core having fibers oriented at an angle of about ±25° to ±45° as measured from the longitudinal axis of the frame whereby torsional stiffness is imparted to said frame.

2. The racket of claim 1 wherein the core is fabricated from materials selected from the group of wood, plastic composites and cellular plastic materials.

3. The racket of claim 1 wherein the core is fabricated of wood.

4. The racket of claim 1 wherein said fiber reinforced plastic skin is selected from the group consisting of graphite fiber, glass fiber, organic and inorganic fiber reinforced thermoplastic and modified thermoset resins and mixed glass fiber, graphite fiber, organic and inorganic fiber reinforced thermoplastic and modified thermoset resins.

5. The racket of claim 1 wherein the fibers in the throat section are oriented at ±30° as measured from the longitudinal axis of the core.

6. The racket of claim 5 wherein the fiber reinforced skin of the throat section includes not more than 50% of fibers oriented at 0° from the longitudinal axis of the frame.

7. The racket of claim 1 wherein said skin has a thickness ranging from about 20 to 60 mils.

8. The racket of claim 1 wherein the thickness of the skin ranges from about 35 to 40 mils.

9. The racket of claim 1 wherein the plastic of the fiber reinforced plastic skin is nylon and the fiber is graphite.

10. The racket of claim 1 wherein the fiber reinforced plastic skin is bonded to a wooden core by means of an elastomer modified thermoset adhesive.

11. The method of making a frame of a game racket comprising: forming a central core having an integral head portion and handle portion defining there between the throat section, said head portion having a generally curvilinear shape; forming a fiber reinforced plastic skin having continuous fibers oriented therein solely in a closed curvilinear pattern following the general curvilinear shape of said head portion bonding said fiber reinforced skin to each of the opposing surfaces of the central core on the head portion; forming a fiber reinforced plastic skin for the throat section having fibers oriented at an angle from ±25° to ±45° as measured from the longitudinal axis of the frame; bonding a fiber reinforced plastic skin to each of the opposing surfaces of the central core in the throat section, said skin in the throat section overlapping the skin on the head portion of the core at the junction of the handle and head portion.

12. The method of claim 11 wherein the skins are bonded to the core at temperature ranging from ambient temperature to about 120° C. and at pressures ranging from about atmospheric pressure to about 3 atmospheres pressure.

* * * * *